US012285058B2

(12) United States Patent
Morgan

(10) Patent No.: US 12,285,058 B2
(45) Date of Patent: Apr. 29, 2025

(54) ADJUSTABLE STRAP SYSTEM

(71) Applicant: NIKE, Inc., Beaverton, OR (US)

(72) Inventor: Daniel P. Morgan, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 91 days.

(21) Appl. No.: 17/887,072

(22) Filed: Aug. 12, 2022

(65) Prior Publication Data

US 2023/0051747 A1 Feb. 16, 2023

Related U.S. Application Data

(60) Provisional application No. 63/233,510, filed on Aug. 16, 2021.

(51) Int. Cl.
*A41C 3/00* (2006.01)
*A44B 11/02* (2006.01)

(52) U.S. Cl.
CPC ..... *A41C 3/0028* (2013.01); *A44B 11/02* (2013.01)

(58) Field of Classification Search
CPC .. A41C 3/0028; A41D 1/002; A41D 13/1236; A41D 13/12; A41D 13/1245; A41D 27/12; A41F 1/008; A41F 1/00
USPC ..... 450/86
See application file for complete search history.

(56) References Cited

U.S. PATENT DOCUMENTS 844,082 A * 2/1907 Barabasz ..... A44B 11/04 24/186
2,378,906 A * 6/1945 Blum ..... A41C 3/00 450/87
2,413,180 A 12/1946 Grisanti
2,439,339 A 4/1948 Grisanti
2,455,036 A * 11/1948 Boylan ..... A41F 1/006 450/86
2,487,649 A 11/1949 Grisanti
2,589,802 A 3/1952 Amedeo
2,749,556 A 6/1956 Lampkowitz
2,770,810 A 11/1956 De Grazia
2,905,948 A 9/1959 Grisanti
3,218,686 A 11/1965 Julia
4,881,275 A 11/1989 Cazares et al.
5,566,397 A 10/1996 Scott
(Continued)

FOREIGN PATENT DOCUMENTS

WO 2011/153611 A2 12/2011

OTHER PUBLICATIONS

International Search Report and Written Opinion received for PCT Patent Application No. PCT/US2022/040327, mailed on Nov. 10, 2022, 10 pages.

(Continued)

*Primary Examiner* — Timothy K Trieu
(74) *Attorney, Agent, or Firm* — Shook, Hardy & Bacon L.L.P.

(57) ABSTRACT

Aspects herein are directed to a strap system having an adjustable stretch that is suitable for upper body garments, lower body garment, and articles such as bags and articles of footwear. The strap system includes a pair of straps that are coupled together in a face sharing relationship by a coupling mechanism. One of the straps in the pair of straps has greater stretch properties than the other strap. A total stretch of the strap system is adjustable by moving the coupling mechanism along a length of the strap system.

7 Claims, 8 Drawing Sheets

(56) References Cited

U.S. PATENT DOCUMENTS

| | | | | |
|---|---|---|---|---|
| 6,006,364 | A * | 12/1999 | Newsom | A41F 15/02 450/86 |
| 6,681,406 | B2 | 1/2004 | Yang | |
| 8,474,065 | B2 | 7/2013 | Kingsbury et al. | |
| 8,631,515 | B2 * | 1/2014 | Van Sisseren | A41F 15/002 450/86 |
| 9,326,883 | B2 | 5/2016 | Serola | |
| 9,375,045 | B2 | 6/2016 | Farris et al. | |
| 2010/0011487 | A1 | 1/2010 | Kim | |
| 2012/0096629 | A1 | 4/2012 | Swancutt et al. | |
| 2014/0115755 | A1 | 5/2014 | Mahar | |
| 2017/0224357 | A1 | 8/2017 | Whalen et al. | |
| 2020/0378040 | A1 | 12/2020 | Aleman et al. | |
| 2021/0015216 | A1 | 1/2021 | Kim | |
| 2023/0180868 | A1 * | 6/2023 | Johnson | A41D 31/10 2/183 |

OTHER PUBLICATIONS

First Line Equipment |FROG.PRO Operator Belt and Pouches, urbansurvivorblog.com, Jun. 21, 2018, 11 pages.
ROK Straps ROK-10025, Black 18—60"Motorcycle/ATV Adjustable Stretch Strap" amazon.com, Aug. 11, 2009, 5 pages.
Serola Sacroiliac Belt, Medium—Fits 34 to 40"Hip Measurement" amazon.com, Apr. 4, 2004, 11 pages.

* cited by examiner

ADJUSTABLE STRAP SYSTEM

CROSS-REFERENCE TO RELATED APPLICATIONS

This application claims the benefit of priority to U.S. Provisional Application No. 63/233,510 (filed Aug. 16, 2021), the entirety of which is incorporated by reference herein.

TECHNICAL FIELD

Aspects herein are directed to a strap system for a garment or article where the strap system has adjustable stretch properties.

BACKGROUND

Traditionally, a garment strap has an adjustable length without the ability to adjust the stretch properties of the strap itself.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1. A strap system comprising: a first strap having a first end and a second end, the first strap fixed to a first textile element at the first end; a second strap having a third end and a fourth end, the second strap fixed to a second textile element at the fourth end, wherein the first strap is in a face sharing relationship with the second strap; and a coupling mechanism securing the first strap to the second strap, the coupling mechanism slidable along a length of the first strap and the second strap, wherein the first end of the first strap and the third end of the second strap are positioned at a first side of the coupling mechanism, and wherein the second end of the first strap and the fourth end of the second strap are positioned at an opposite second side of the coupling mechanism.

Clause 2. The strap system according to clause 1, wherein the second end of the first strap is unfixed to the second textile element, and wherein the third end of the second strap is unfixed to the first textile element.

Clause 3. The strap system according to any of clauses 1 through 2, wherein the first strap has a first amount of stretch that is greater than a second amount of stretch of the second strap.

Clause 4. The strap system according to any of clauses 1 through 3, wherein an amount of stretch of the strap system is dependent on a location of the coupling mechanism along the length of the first strap and the second strap.

Clause 5. The strap system according to any of clauses 1 through 4, wherein when the coupling mechanism is located closer to the first end of the first strap and the third end of the second strap, the strap system has a first amount of stretch, and wherein when the coupling mechanism is located closer to the second end of the first strap and the fourth end of the second strap, the strap system has a second amount of stretch that is greater than the first amount of stretch.

Clause 6. The strap system according to clause 5, wherein when the coupling mechanism is located closer to the first end of the first strap and the third end of the second strap, a first distance measured from the first end of the first strap to the first side of the coupling mechanism is smaller than a second distance measured from the fourth end of the second strap to the second side of the coupling mechanism.

Clause 7. The strap system according to any of clauses 5 through 6, wherein when the coupling mechanism is located closer to the second end of the first strap and the fourth end of the second strap, a third distance measured from the fourth end of the second strap to the second side of the coupling mechanism is smaller than a fourth distance measured from the first end of the first strap to the first side of the coupling mechanism.

Clause 8. The strap system according to any of clauses 1 through 7, wherein the second strap is formed of a low-stretch or no-stretch material.

Clause 9. The strap system according to any of clauses 1 through 8, wherein the first strap and the second strap remain in the face sharing relationship when the coupling mechanism is positioned at different locations along the length of the first strap and the second strap.

Clause 10. An upper body garment comprising: a first textile element forming a first portion of the upper body garment; a second textile element forming a second portion of the upper body garment; and a strap system comprising: a first strap having a first end and a second end, the first end of the first strap fixed to the first textile element of the upper body garment; a second strap having a third end and a fourth end, the fourth end of the second strap fixed to the second textile element of the upper body garment, wherein the first strap is in a face sharing relationship with the second strap; and a coupling mechanism securing the first strap to the second strap, wherein the coupling mechanism is slidable along a length of the first strap and the second strap.

Clause 11. The upper body garment according to clause 10, wherein the first strap and the second strap remain in the face sharing relationship when the coupling mechanism is positioned at different locations along the length of the first strap and the second strap.

Clause 12. The upper body garment according to any of clauses 10 through 11, wherein the first end of the first strap and the third end of the second strap are positioned at a first side of the coupling mechanism, and wherein the second end of the first strap and the fourth end of the second strap are positioned at an opposite second side of the coupling mechanism.

Clause 13. The upper body garment according to any of clauses 10 through 12, wherein the second end of the first strap is unfixed to the second textile element of the upper body garment, and wherein the third end of the second strap is unfixed to the first textile element of the upper body garment.

Clause 14. The upper body garment according to any of clauses 10 through 13, wherein the upper body garment is a bra, and wherein the strap system forms at least a portion of a shoulder strap of the bra.

Clause 15. The upper body garment according to any of clauses 10 through 13, wherein the upper body garment is a bra, and wherein the first textile element forms an apex portion of a breast-covering surface of the bra, and wherein the second textile element forms a shoulder strap of the bra.

Clause 16. The upper body garment according to any of clauses 10 through 15, wherein the first strap has a first amount of stretch that is greater than a second amount of stretch of the second strap.

Clause 17. The upper body garment according to any of clauses 10 through 16, wherein an amount of stretch of the strap system is dependent on a location of the coupling mechanism along the length of the first strap and the second strap.

Clause 18. The upper body garment according to any of clauses 10 through 17, wherein when the coupling mechanism is located closer to the first end of the first strap and the third end of the second strap, the strap system has a first amount of stretch, and wherein when the coupling mechanism is located closer to the second end of the first strap and the fourth end of the second strap, the strap system has a second amount of stretch that is greater than the first amount of stretch.

Clause 19. A method of assembling a strap system comprising: affixing a first end of a first strap to a first textile element, wherein the first strap further includes a second end; affixing a fourth end of a second strap to a second textile element, wherein the second strap further includes a third end; positioning the first strap and the second strap such that the first strap and the second strap are in a face sharing relationship; and securing the first strap and the second strap using a coupling mechanism such that the coupling mechanism is slidable along a length of the first strap and the second strap, wherein the first end of the first strap and the third end of the second strap are positioned at a first side of the coupling mechanism and the second end of the first strap and the fourth end of the second strap are positioned at an opposite second side of the coupling mechanism.

Clause 20. The method of assembling the strap system according to clause 19, wherein the second end of the first strap is unfixed to the second textile element, and wherein the third end of the second strap is unfixed to the first textile element.

BRIEF DESCRIPTION OF THE DRAWINGS

Examples of aspects herein are described in detail below with reference to the attached drawing figures, wherein.

DETAILED DESCRIPTION

Figure 1:
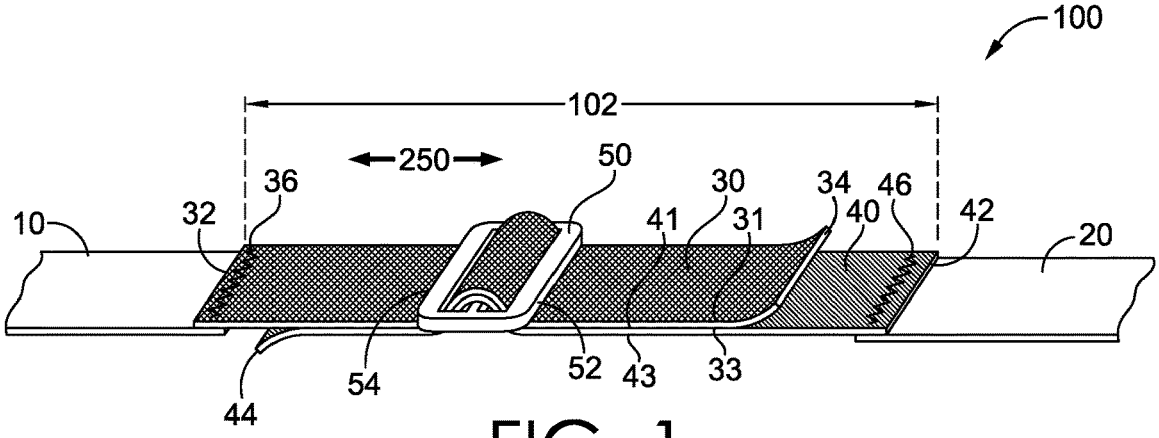
FIG. 1 illustrates a perspective view of a strap system in an un-tensioned state, in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditionally, adjustable straps used in garments or articles, such as, for example, brassieres (i.e. bras), tank tops, pants, bags, purses, articles of footwear, and the like, are manufactured from a single material having a defined stretch property. As a result, although the strap length can often be adjusted for these straps, the overall elasticity or stretch properties of these straps cannot be adjusted. This may, in some instances lead to discomfort, particularly in the case of, for example, bra straps.

Thus, a strap system with adjustable stretch properties is provided herein. The strap system includes two straps in a face sharing relationship coupled by a coupling mechanism, where one strap includes a different stretch property than the other strap. For instance, a first strap of the strap system may have a high stretch property, meaning that its length can be increased by at least 10% of its original length when a force is applied in a directional axis that is parallel to its length. The second strap of the strap system may have no stretch or minimal stretch properties, meaning that there is minimal to no change in its length or the change in its length is less than the change in length of the first strap when the force is applied in the direction that is parallel to its length.

When the strap system is incorporated into an article of apparel, a first end of the first strap is fixed by, for example, stitching or is otherwise attached to a first element, such as a first textile element, of the article of apparel. Further, a second end of the second strap is also fixed by stitching or otherwise attached to a second element, such as a second textile element, of the article of apparel. In some instances, a distance between the first end of the first strap and the second end of the second strap can define a length of the strap system (e.g., as measured along the first and second straps). In example aspects, the first textile element and the second textile element are located at opposing ends of the strap system. For example, the first textile element may be part of a front piece of the article of apparel and the second textile element may be part of a back piece of the article of apparel, although other configurations are contemplated herein.

In accordance with the example provided herein, because the first strap has a greater stretch property than the second strap, and because only the first end of the first strap is attached to the first textile element, an "unlocked" length of the first strap will determine how much the strap system will be able to stretch. In other words, for a given length of the strap system, a location of the coupling mechanism along the length of the strap system can determine an amount (i.e., available length) of the first strap that is available to stretch when a tension force is applied to the first textile element or the second textile element. For example, for a given length of the strap system, when the coupling mechanism is located closer to the first end of the first strap that is fixed to the first textile element, the available length of the first strap is smaller than when the coupling mechanism is located farther from the first end of the first strap (or located closer to the second end of the second strap that is fixed to the second textile element). Stated differently, when the coupling mechanism is located closer to the first end of the first strap, a majority of a length of the strap system is "locked" by the second strap and the coupling mechanism. As such, the strap system will only stretch a slight amount when a tension force is applied to the first textile element or the second textile element in a lengthwise direction. As the coupling mechanism is moved away from the first end of the first strap, a greater amount of the first strap is "unlocked," thereby allowing the strap system to increasingly stretch to a greater extent when the tension force is applied.

The term "article of apparel" as used herein is meant to encompass a number of different configurations adapted to cover a body of a wearer when the article of apparel is worn. For example, the configurations may include upper body garments, lower body garments, socks, articles of footwear (i.e., shoes, boots, sandals, and the like), gloves, hats, masks, body suits, dresses, jumpers, overalls, and the like. The term "upper body garment" as used herein is meant to encompass a number of different configurations adapted to cover an upper torso area of a wearer when the upper body garment is worn. The configurations may include a jacket or coat, a pullover, a hoodie, a vest, a shirt, a uniform, a t-shirt, a jersey, a bra, and the like. The term "lower body garment" as used herein is meant to encompass a number of different configurations adapted to cover a lower body area of a wearer when the garment is worn. The configurations may include, short pants, long pants, capri pants, jeans, trousers, skirts, skorts, leggings, tights, and the like. Positional or directional terms used to describe the upper body garment and the lower body garment such as front, back, internal, external, upper, lower, center, medial, lateral, anterior, posterior, and the like refer to the garment being worn as intended by a wearer standing upright. Thus, for example, the term "front" means configured to cover a front torso area of a wearer, and the term "back" means configured to cover a back torso area of a wearer. The term "upper" means closer to a neck opening of an upper body garment or a torso opening of a lower body garment, and the term "lower" means closer to a torso opening of the upper body garment or an leg opening of the lower body garment. The term "right side portion" means located on a right side of a garment when worn by a wearer, and the term "left side portion" means located on a left side of the garment when worn by the wearer.

The term "inner" when describing a layer of material forming the strap system means the layer that is positioned closest to a body surface of a wearer with respect to other layers forming the strap system. The term "outer" when describing a layer of material forming the strap system means the layer that is furthest away from the wearer's body surface compared to other layers of the strap system. The term "textile" as used herein means any type of pliable cloth or fabric that is woven, non-woven, knit, braided, or the like, that can be used to produce, for example, articles of apparel as described herein.

The term "stretch property" when referring to the strap system refers to the property of being able to reversibly/temporarily deform lengthwise to elongate (i.e., become longer, or increase in length). In example aspects, with respect to at least the first strap of the strap system, the term stretch property means that the first strap reversibly stretches by at least 10% of its original length (i.e., unstretched state), when a pulling or tension force is applied to the first strap in a lengthwise direction. Once the applied force is removed, the first strap is able to substantially or entirely return to its original length or in other words, its unstretched state. In example aspects, the second strap may exhibit little to no stretch in response to a tension force. Stated differently, the second strap may exhibit no stretch or a stretch that is less than 10% of its original length (i.e., unstretched state) when a pulling or tension force is applied to the second strap in a lengthwise direction.

In example aspects, the stretch properties of the first and second straps of the strap system may be determined by the presence of and/or the percentage by weight of elastic yarns used to form the first and second straps. The term "elastic yarn" refers to a yarn that is able to resiliently stretch (e.g., under tension) from its original length and to substantially return to its original length (e.g., when the tension force is removed). For example, an elastic yarn may stretch to at least about 30%, at least about 40%, at least about 50%, at least about 60%, at least about 70%, at least about 80%, at least about 90%, at least about 100%, or up to about 200% of its original length in response to a tension force and to substantially return to its original length when the tension force is removed. Some example elastic yarns include spandex, LYCRA®, thermoplastic polyurethane (TPU) yarns, rubber, and the like. Elastic yarns can include various forms, such as monofilament having one or more components (e.g., bicomponent yarn having a core/sheath or side-by-side) or multifilament. Thus, in example aspects, the first strap may contain a greater percentage by weight of elastic yarns compared to the second strap. Aspects herein further contemplate that the second strap may not include elastic yarns. In other example aspects, an elastomeric material with stretch properties may be used to form, for example, the first strap. The term "end" refers to the outermost short edges of the strap that define the strap width. The strap length is defined by the outermost long edges of the strap.

As used herein, the term "approximately" or "about" means within a range of plus or minus 10 percent of an indicated value.

The use of positional terms when describing the edges of the straps of the strap system assumes that each strap is properly positioned with respect to each other. The term "medial" when used to describe an edge means an edge located closer to a midline of, for example, a garment that includes the strap system disclosed herein. Thus, a medial edge of the strap system is closer to the midline of the garment when the strap system is incorporated into the garment. The term "lateral" when used to describe an edge refers to an edge located farther from the midline of the garment. Thus, a lateral edge of the strap system is located farther from the midline of the garment and closer to, for instance a lateral edge of the garment. The term "face sharing relationship" when used to describe the relationship between the first strap and the second strap of the strap system refers to a first planar surface of, for example, the first strap being positioned such that it is facing a second planar surface of, for example, the second strap. In other words, the term "face sharing relationship" refers to the placement of the straps relative to one another such that the first planar surface of the first strap and the second planar surface of the second strap are in contact or near contact with each other.

Unless indicated otherwise, all measurements provided herein are taken when the strap system is at standard ambient temperature and pressure (298.15 K and 100 kPa) and the strap components of the strap system are in a resting state (i.e., unstretched).

FIG. 1 depicts a strap system 100 that includes a first strap 30 and a second strap 40, which are coupled to each other by a coupling mechanism 50. In example aspects, the coupling mechanism 50 may include a slide buckle (i.e., "slide", or tri-glide buckle) although other suitable slidable coupling mechanisms are also contemplated without departing from aspects herein. The coupling mechanism 50 may be comprised of a plastic, metal, or polymer material, depending on the rigidity desired. Further, the overall shape of the coupling mechanism 50 may be rounded or rectangular (as shown in the figures), depending on the use.

The coupling mechanism 50 is slidable in a lengthwise direction 250 along a length 102 of the strap system 100. The first strap 30 is in a face sharing relationship with the second strap 40, meaning that an inner face 33 of the first strap 30 faces or is positioned adjacent to an outer face 41 of the second strap 40. An inner face 43 of the second strap 40 is configured to face a wearer or an interior of an article when the strap system 100 is incorporated into a garment or the article. It is contemplated that the first strap 30 and the second strap 40 may have the same length, or one of the first strap 30 or the second strap 40 may be longer than the other. Although the strap system 100 is depicted as having the first strap 30 being placed over the second strap 40, based on the use desired, it is also contemplated that the strap system 100 may be configured to have the second strap 40 over the first strap 30 when coupled by the coupling mechanism 50, without departing from aspects herein. In other words, it is also contemplated that the strap system 100 may have the inner face 43 of the second strap 400 facing or positioned adjacent to the outer face 31 of the first strap 30.

In example aspects, the first strap 30 may have stretch properties and may be formed of a stretch knit or stretch woven material that incorporates elastic yarns (e.g., elastane fibers). For example, the first strap 30 may be formed of nylon and elastane fibers and/or polyester and elastane fibers. Alternatively, the first strap 30 may be formed from a stretchable elastomeric polymer material (e.g., thermoplastic polyurethane, silicone, polyethylene, and the like, or any combination of these materials that would be suitable in accordance with aspects herein). The second strap 40 may be formed from a low stretch or no stretch material (e.g., polyester and/or nylon) to form a tightly woven or braided material that does not include elastic yarns/fibers. Alternatively, the second strap 40 may be formed from a low or no stretch polymer or natural material (e.g., leather).

When incorporated into an article, a first end 32 of the first strap 30 is coupled (e.g., stitched, bonded, welded, integrally knitted, or otherwise attached/fixed) to a first textile element 10 at a first attachment point 36, while a second end 34 of the first strap 30 is left detached/unfixed (i.e., free). A fourth end 42 of the second strap 40 is coupled (e.g., stitched, bonded, welded, integrally knitted, or otherwise attached/affixed) to a second textile element 20 at a second attachment point 46, while a third end 44 of the second strap 40 is left detached/unfixed. As depicted, the first textile element 10 and the second textile element 20 are located on opposing sides of the coupling mechanism 50. In example aspects, the first textile element 10 and the second textile element 20 are indirectly joined by coupling the first strap 30 to the second strap 40 by way of the coupling mechanism 50, as shown in FIG. 1 to form the strap system 100.

In examples of the present disclosure, the strap system 100 is adjustable in a plurality of different manners by adjusting a position of the coupling mechanism 50 relative to one or both straps 30 and 40. For instance, both a stretch property and an overall length 102 of the strap system can be increased, decreased, or maintained depending on how the coupling mechanism 50 is adjusted (e.g., slid relative to one or both attachment points 36 and 46). In examples, the stretch property of the strap system 100 is relative to the overall length 102 of the strap system, as measured from one attachment point 36 to the other attachment point 46. For example, if the overall length 102 is x (e.g., 10 cm) and the strap system 100 can reversibly elongate to y (e.g., 12 cm), then the stretch property can be quantified as y over x (e.g., 1.2). As such, the strap system 100 includes at least eight different adjustments that can be made to alter the properties of the strap system 100: increase overall length 102 and increase stretch property; increase overall length 102 and maintain stretch property; increase overall length 102 and decrease stretch property; decrease overall length 102 and increase stretch property; decrease overall length 102 and maintain stretch property; decrease overall length 102 and increase stretch property; maintain overall length 102 and increase stretch property; and maintain overall length 102 and decrease stretch property.

Figure 2A:
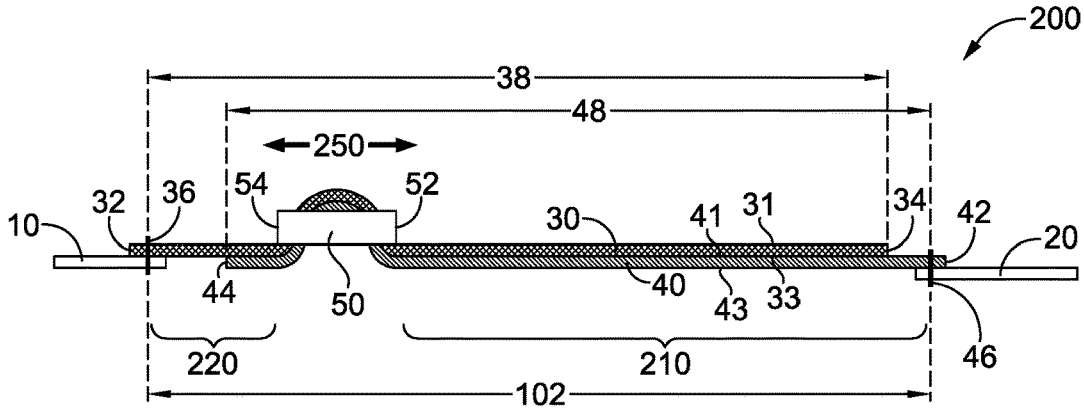
FIG. 2A illustrates a side view of the strap system shown in FIG. 1 having a coupling mechanism positioned closer to a first side of the strap system than a second side of the strap system, in accordance with aspects herein.
Figure 2B:
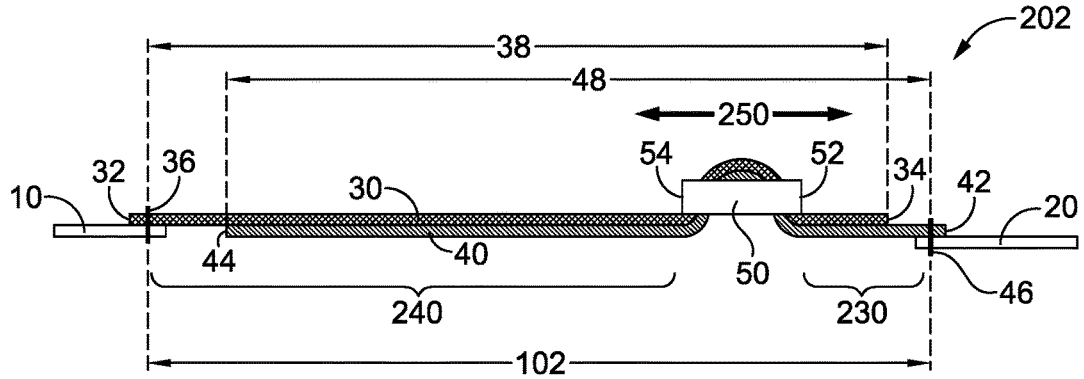
FIG. 2B illustrates a side view of the strap system shown in FIG. 1 having the coupling mechanism positioned closer to the second side of the strap system than the first side of the strap system, in accordance with aspects herein.

To help illustrate adjustability provided via the system 100, reference is made to FIGS. 2A and 2B. For example, FIG. 2A depicts a first state or configuration 200 for a strap system, and FIG. 2B depicts a second state or configuration 200 for the strap system. In both FIGS. 2A and 2B, the strap system includes a same given length 102 (e.g., the length 102 is maintained from one state to the other state), and examples of the present disclosure provide for an adjustable stretch property for that given length 102. As shown in FIG. 2A, the first strap 30 has a length 38, and the second strap 40 has a length 48 where the first strap 30 and the second strap 40 are coupled to each other in a face sharing relationship by the coupling mechanism 50. In examples, a stretch property of the strap system 100 can be determined based on a location of the coupling mechanism 50 along the length 102 of the strap system 100. That is, the stretch property of the strap system 100 can be based on an amount (e.g., length) of the first strap 30 between the attachment point 36 and the coupling mechanism 50 and on an amount (e.g., length) of the second strap 40 between the attachment point 46 and the coupling mechanism 50.

As shown in FIG. 2A, in a lower stretch configuration 200 (e.g., based on the given length 102), the coupling mechanism 50 is located closer to the attachment point 36 and farther from the attachment point 46, such that less of the first strap 30 is forming the overall length 102 and more of the second strap 40 is forming the length 102. That is, the lower stretch configuration 200 results in a first distance 220 measured from the first attachment point 36 to a first side 54 of the coupling mechanism being less than a second distance 210 measured from the second side 52 of the coupling mechanism 50 to the second attachment point 46.

As shown in FIG. 2B, in a higher stretch configuration 202 of the strap system 100, the coupling mechanism 50 has been moved (while maintaining a similar length 102 of the strap system) along the lengthwise direction 250 such that the second side 52 of the coupling mechanism 50 is located farther from the first attachment point 36 of the first strap 30. In the higher stretch configuration 202, a resulting "unlocked" third distance 240 of the first strap 30 measured from the first attachment point 36 of the first strap 30 to the first side 54 of the coupling mechanism 50 is greater than a fourth distance 230 measured from the second attachment point 46 to the second side 52 of the coupling mechanism 50. As such, the strap system 100 in FIG. 2B will stretch to a greater extent (as compared to the configuration in FIG. 2A) when a tension force is applied to the first textile element 10 or the second textile element 20 in the lengthwise direction 250 due to the stretch properties of the first strap 30. That is, as between FIGS. 2A and 2B, the given length 102 of the strap system 100 can be maintained relatively constant, while the stretch property can be adjusted (e.g., decreased or increased) depending on a position of the coupling mechanism 50 relative to the attachment points.

In some instances, a strap system 102 can be categorized based on a ratio of (a) the untensioned length (e.g., 220 or 240) of the first strap 30 between the first attachment point 36 and the coupling mechanism 50 and (b) the untensioned length (e.g., 210 or 230) of the second strap 40 between the second attachment point 46 and the coupling mechanism 50. For instance, where the ratio of (a) to (b) is less than 1, the strap system can be categorized as "low stretch;" where the ratio of (a) to (b) is 1, the strap system can be categorized as "medium stretch;" and where the ratio of (a) to (b) is greater than 1, the strap system can be categorized as "high stretch." For example, if a strap system includes a total length (e.g., 102) of 10 cm, with an (a) to (b) ratio of 2:3 (e.g., 4 cm to 6 cm), then the first strap system can be categorized as "low stretch;" and likewise if a strap system includes a total length of 8 cm, with an (a) to (b) ratio of 3:5 (e.g., 3 cm to 5 cm), then the strap system can be categorized as "low stretch." In another example, if a strap system includes a total length (e.g., 102) of 10 cm, with an (a) to (b) ratio of 4:1 (e.g., 8 cm to 2 cm), then the first strap system can be categorized as "high stretch;" and likewise if a strap system includes a total length of 8 cm, with an (a) to (b) ratio of 3:1 (e.g., 6 cm to 2 cm), then the strap system can be categorized as "high stretch." Based on this system for categorization, the strap system in FIG. 2A could be categorized as a "low stretch" system, and the strap system in FIG. 2B could be categorized as a "high stretch" system.

To explain further, in some example, in the low stretch configuration 200 only the first distance 220 (or length) of the first strap 30 is "unlocked" and free to stretch. Because the first strap 30 has a greater stretch property than the second strap 40, and because only the first end 32 of the first strap 30 is attached to the first textile element 10, the available length (i.e., the first distance 220) of the first strap 30 can determine how much the strap system 100 stretches when a tension force is applied to the first textile element 10 or the second textile element 20. In the low stretch configuration 200, the available length of the first strap 30 is limited by the coupling mechanism 50 to the relatively smaller first distance 220. In other words, a majority of the length 38 of the first strap 30 is "locked" by the position of the coupling mechanism 50 relative to the first strap 30. As such, the strap system 100 will only stretch a slight amount when a tension force is applied to the first textile element 10 or the second textile element 20 in the lengthwise direction 250 (e.g., as compared to a different configuration in which the coupling mechanism 50 is slid closer to the second end 34 of the first strap 30). Since the second strap 40 has low or no stretch, and because only the fourth end 42 of the second strap 40 is attached or fixed to the second textile element 20, the available length (i.e., the first distance 220) of the first strap 30 will determine how much the strap system 100 will stretch when a tension force is applied to the first textile element 10 or the second textile element 20. Because the second distance 210 is relatively greater than the first distance 220, the strap system 100 will only stretch a slight amount when a tension force is applied to the second textile element 20 or the first textile element 10 (e.g., as compared to a different configuration in which the first distance 220 or more equal to or greater than the second distance 210). Stated differently, when a ratio of the first distance 220 to the second distance 210 is less than 1 or when a ratio of the second distance 210 to the first distance 220 is greater than 1, as shown in FIG. 2A, then the strap system 100 will exhibit a relatively small amount of stretch (e.g., as compared to when a ratio of the first distance 220 to the second distance 210 is greater than, or equal to, 1). when a tension force is applied to the first textile element 10 or the second textile element 20 in the lengthwise direction 250.

Referring to FIG. 2B, as described above, since the second strap 40 has low or no stretch, and because only the fourth end 42 of the second strap 40 is attached or fixed to the second textile element 20, the available length (i.e., the third distance 240) of the first strap 30 will determine how much the strap system 100 will stretch when a tension force is applied to the first textile element 10 or the second textile element 20 in the lengthwise direction 250. Because the third distance 240 is relatively greater than the fourth distance 230, the strap system 100 will stretch a greater amount when a tension force is applied to the second textile element 20 or the first textile element 10 in the lengthwise direction 250. Stated differently, when a ratio of the third distance 240 to the fourth distance 230 is greater than 1 or when a ratio of the fourth distance 230 to the third distance 240 is less than 1, as shown in FIG. 2B, the strap system 100 will stretch to a greater extent (e.g., as compared to when a ratio of the third distance 240 to the fourth distance 230 is less than 1) when a tension force is applied to the first textile element 10 or the second textile element 20 in the lengthwise direction 250.

Figure 3A:
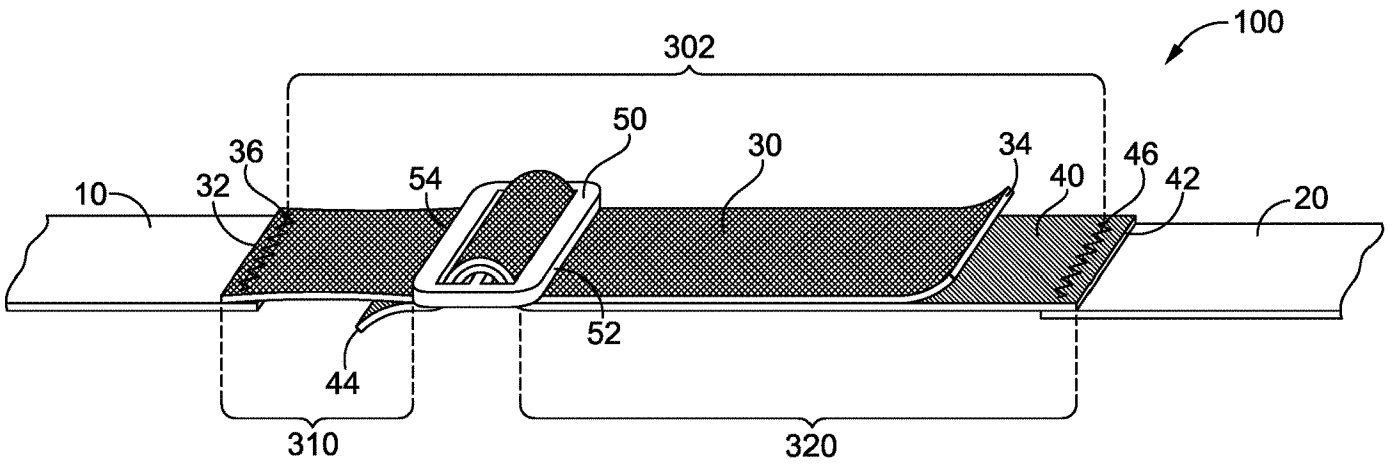
FIG. 3A illustrates a perspective view of the strap system shown in FIG. 2A with the strap system under tension, in accordance with aspects herein.
Figure 3B:
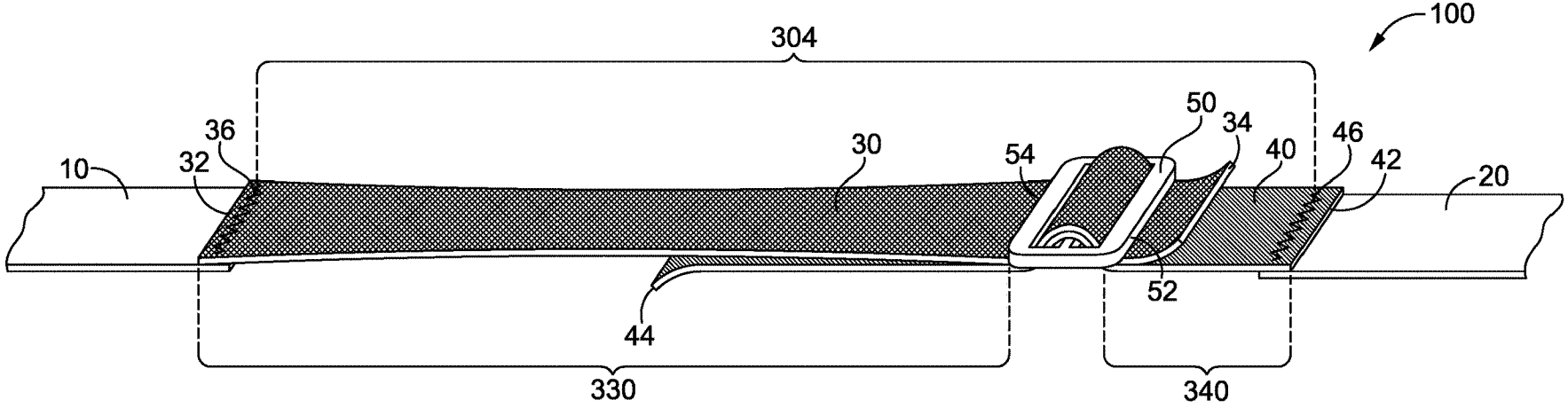
FIG. 3B illustrates a perspective view of the strap system shown in FIG. 2B with the strap system under tension, in accordance with aspects herein.

In some examples, the stretch property of a strap system can be determined based on a length to which the strap system can reversibly elongate. For example, FIG. 3A depicts the strap system 200*b*, which can include the system of FIG. 2A having the low stretch configuration 200 when a tension force is applied to the first textile element 10 or the second textile element 20. In addition, FIG. 3A depicts a stretched length 302 to which the strap system 200*b* can reversibly elongate. That is, in FIG. 2A, the strap system includes the length 102, whereas in FIG. 3A, the strap system has been reversibly elongated to include the length 302. In some examples, the strap system in FIGS. 2A and 3A can be categorized based on the length 102 and the length 302. For example, if the length 102 is x (e.g., 10 cm) and the reversibly elongated length 302 is y (e.g., 12 cm), then the stretch property can be quantified as y over x (e.g., 1.2). Similarly, FIG. 3B depicts the strap system 202*b*, which can include the system of FIG. 2B having the high stretch configuration 202 when a tension force is applied to the first textile element 10 or the second textile element 20. In addition, FIG. 3B depicts a stretched length 304 to which the strap system 202*b* can reversibly elongate. That is, in FIG. 2B, the strap system includes the length 102, whereas in FIG. 3B, the strap system has been reversibly elongated to include the length 304. As explained above, the strap system in FIGS. 2B and 3B can be categorized based on the length 102 and the length 304. For example, if the length 102 is x (e.g., 10 cm) and the reversibly elongated length 302 is y' (e.g., 15 cm), then the stretch property can be quantified as y' over x (e.g., 1.5). Based on these examples, as between FIGS. 2A/3A and FIGS. 2B/3B, the configuration in 2B/3B imparts a larger stretch property.

To explain further, based on the position of the coupling mechanism 50 being closer to the first end 32 of the first strap 30, a tensioned length 320 of the second strap 40 is greater than a tensioned length 310 of the first strap 30. Thus, a ratio of the tensioned length 310 of the first strap 30 to the tensioned length 320 of the second strap 40 is less than 1, which results in the strap system 100 having a lower stretch property when the strap system 100 is in the low stretch configuration 200 (as shown in FIG. 2A). In FIG. 3B, based on the position of the coupling mechanism 50 being closer to the fourth end 42 of the second strap 40, a tensioned length 330 of the first strap 30 is greater than a tensioned length 340 of the second strap 40. Thus, a ratio of the tensioned length 330 of the first strap 30 to the tensioned length 340 of the second strap 40 is greater than 1, which results in the strap system 100 having a higher stretch property when the strap system is in the high stretch configuration 202 (as shown in FIG. 2B). In other words, a stretch property of the strap system 100 is increased as the coupling mechanism 50 is moved away from the first attachment point 36, and the stretch property of the strap system 100 is decreased as the coupling mechanism 50 is moved closer to the first attachment point 36 of the first strap 30.

Figure 4B:
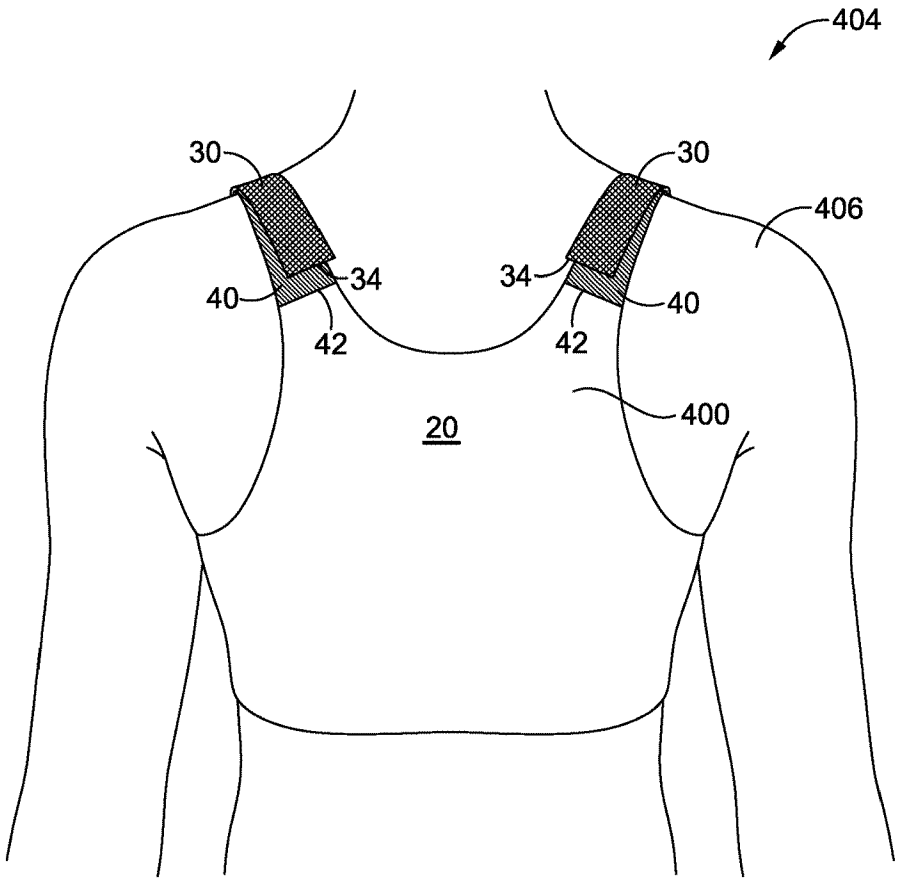
FIG. 4B illustrates a back view of the support garment shown in FIG. 4A, in accordance with aspects herein.
Figure 4A:
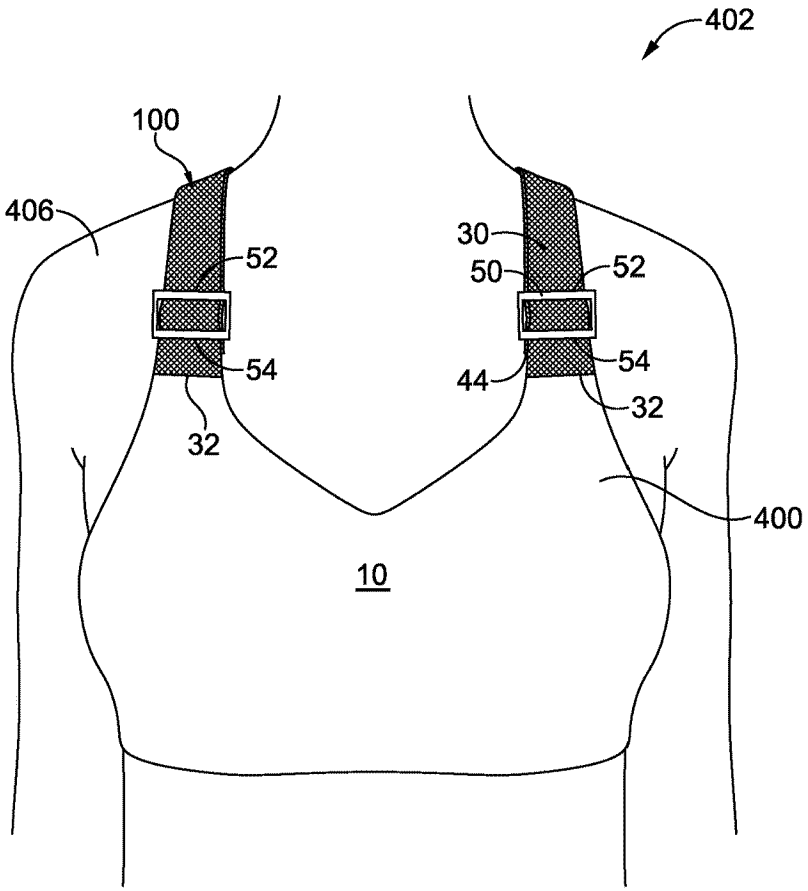
FIG. 4A illustrates a front view of a support garment with the strap system as configured in FIG. 2A, in accordance with aspects herein.
Figure 5B:
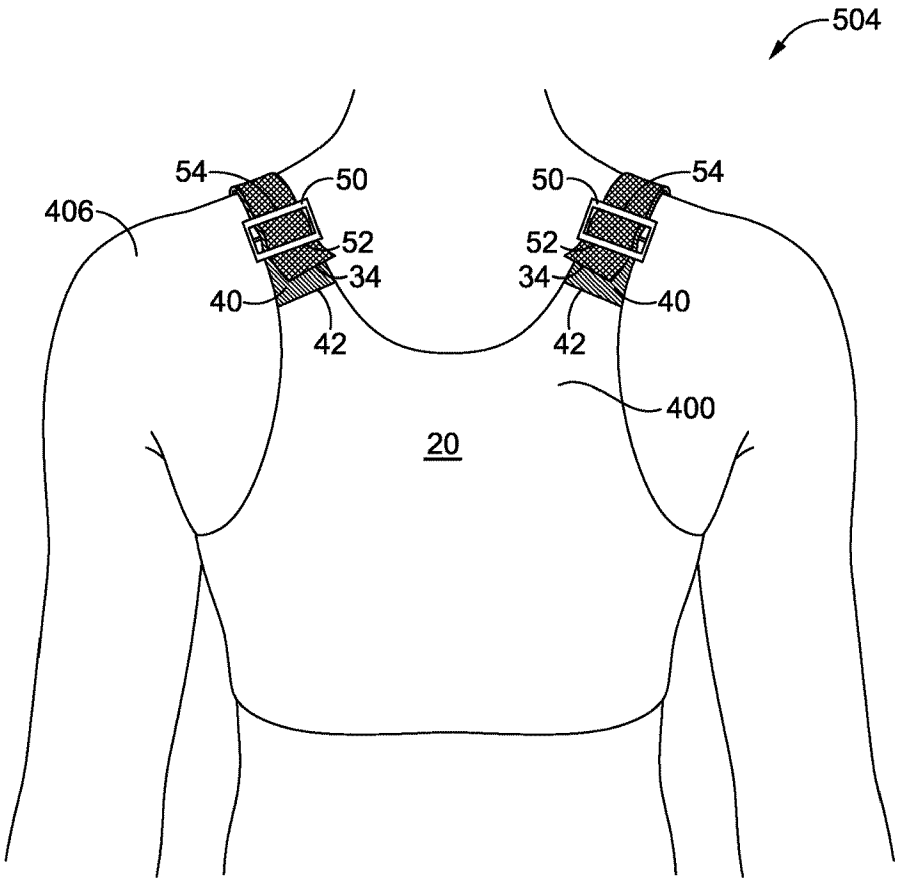
FIG. 5B illustrates a back view of the support garment shown in FIG. 5A, in accordance with aspects herein.
Figure 5A:
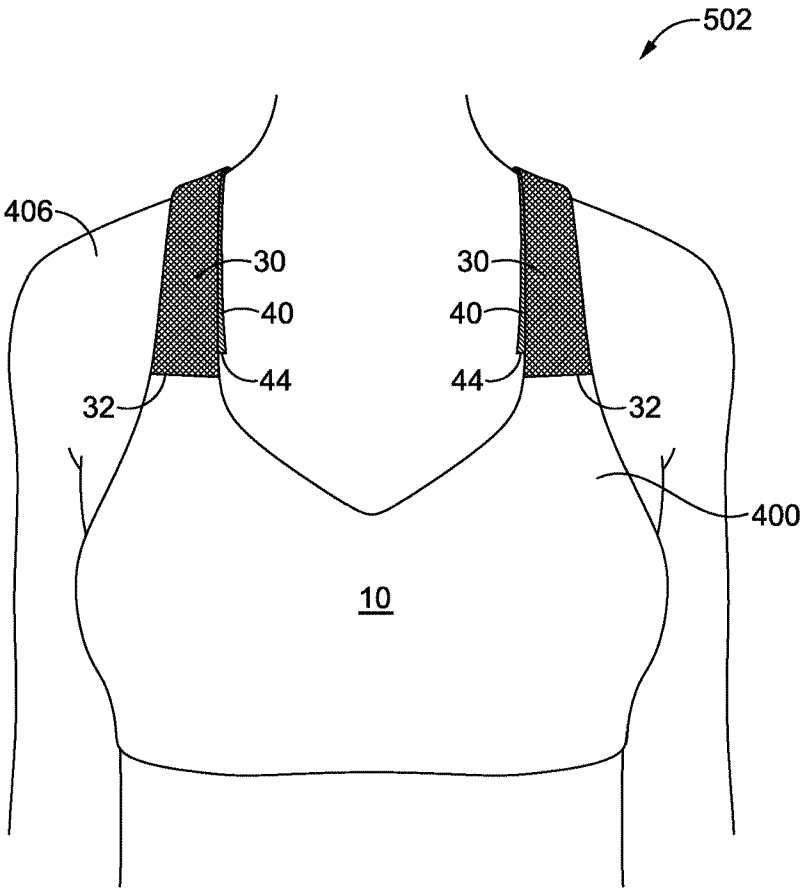
FIG. 5A illustrates a front view of a support garment with the strap system as configured in FIG. 2B, in accordance with aspects herein.

FIG. 4A depicts a front view 402 of an example garment 400 incorporating a pair of strap systems 100, and FIG. 4B depicts a back view 404 of the garment 400. As shown, the garment 400 may be configured as a bra and the strap system 100 may form the bra straps for the bra. Accordingly, the first end 32 of the first strap 30 in each strap system 100 may be fixed to a front textile element 10 of the garment 400 (as shown in FIG. 4A), while the fourth end 42 of the second strap 40 in each strap system 100 may be fixed to a back textile element 20 of the garment 400 (as shown in FIG. 4B). Depending on the amount of stretch desired, a wearer 406 may place the coupling mechanism 50 closer to the first end 32 of the first strap 30 (as shown in both FIGS. 4A and 4B), or any other location along the length of the first strap 30 or the length of the second strap 40, as shown in FIGS. 5A and 5B. For example, as shown in the front view 402 of the support garment 400 in FIG. 4A, the coupling mechanism 50 is closer to the first end 32 of the first strap 30, thus imparting more "lockout" to the strap systems 100. As shown in the back view 504 of the support garment 400 in FIG. 5B, the coupling mechanism 50 is closer to the fourth end 42 of the second strap 40 of the strap system 100, thus imparting a greater amount of stretch to the strap systems 100. The configuration shown in FIGS. 4A and 4B enables each strap system 100 to stretch less than each strap system 100 shown in FIGS. 5A and 5B.

As further shown in FIGS. 4A to 5B, the inner face 43 of the second strap 40 is configured to be in contact with the wearer's skin, while the inner face 33 of the first strap 30 is configured to be in contact with the outer face 41 of the second strap 40. This particular configuration allows the first strap 30 to sit over the second strap 40 so that it can freely stretch to an amount allowed by the coupling mechanism 50 and its location along the lengthwise direction 250 of the strap system 100. In other words, an amount of stretch possible by the first strap 30 is not hampered or disturbed by frictional forces that would be added if the first strap 30 were to be sandwiched between the wearer 406 and, for instance, the second strap 40.

FIGS. 4A to 5B depict some examples, and in at least some instances, the relative positions of the first strap 30 and the second strap 40 can be switched, such that the first strap is attached to the back of the textile element 20 and the second strap can be attached to the front textile element 10. In addition, in at least some examples, instead of attaching to the back of the garment, the second strap 40 can be attached to another textile element that extends from the back to the front (e.g., the second strap 40 might not necessarily extend all the way to the back of the garment and instead may connect, on the front, to another textile element that extends to the back).

Figure 6B:
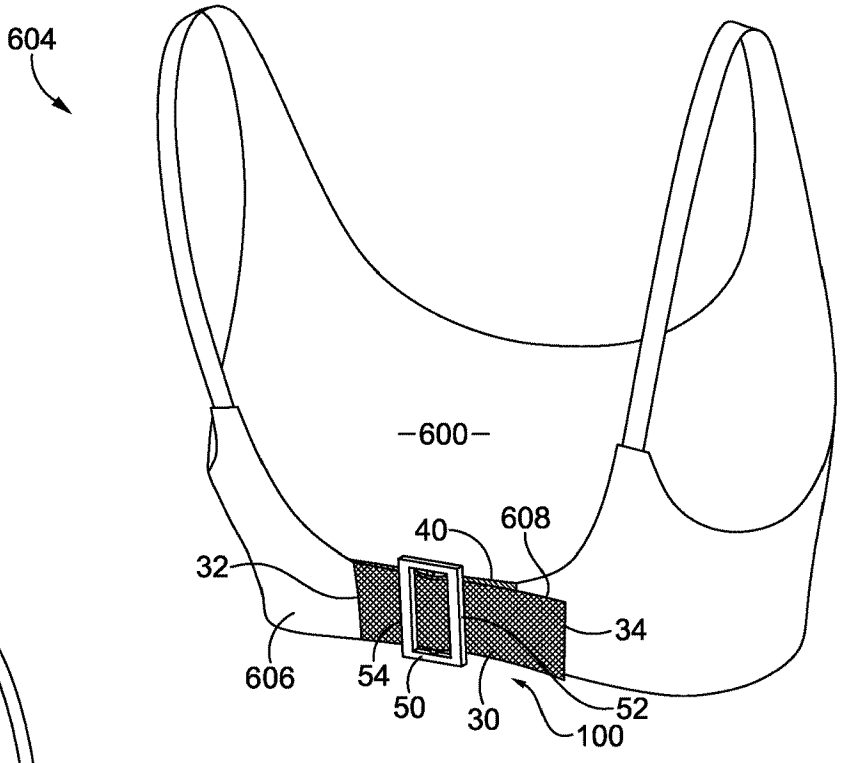
FIG. 6B illustrates a back view of the support garment shown in FIG. 6A with the strap system in a coupled state, in accordance with aspects herein.
Figure 6A:
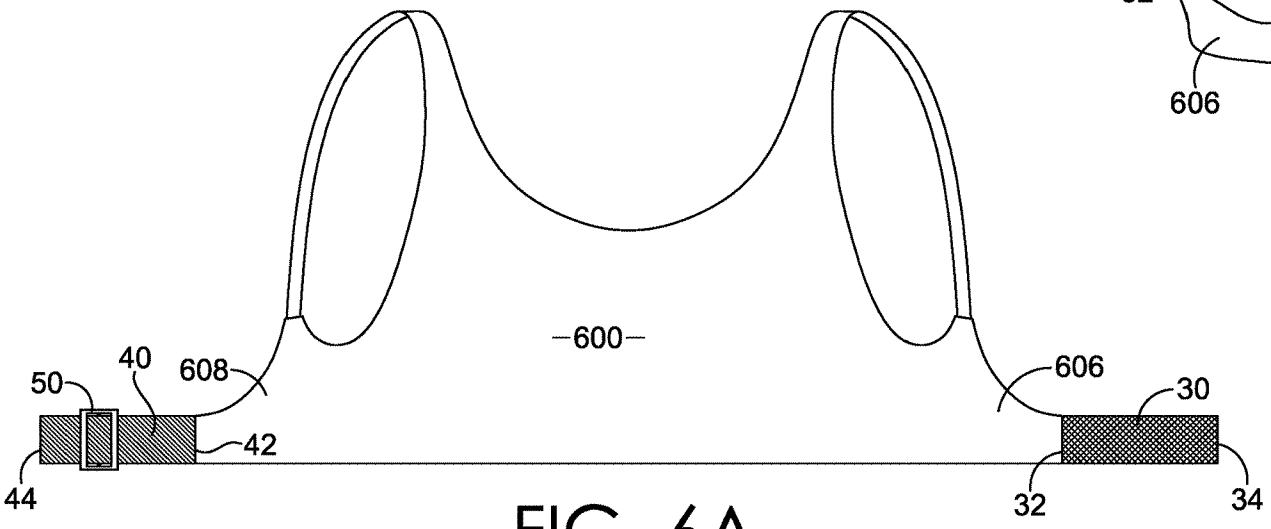
FIG. 6A illustrates a front view of an alternative support garment with a strap system as described herein where the strap system is in an uncoupled state, in accordance with aspects herein.

FIGS. 6A and 6B depict an additional example support garment 600 where the strap system 100 is used as an underband. FIG. 6A depicts a front view 602 of the support garment 600 in an open configuration ready to be worn by a wearer. As shown, the first strap 30 of the strap system 100 is fixed to a first side 606 of the support garment 600 and the second strap 40 of the strap system 100 is fixed to a second side 608 of the support garment 600. The coupling mechanism 50 can be initially coupled to the second strap 40, as shown, or alternatively, may be initially coupled to the first strap 30 (not shown). FIG. 6B depicts a back view of the support garment 600 in a closed configuration where the coupling mechanism 50 couples the first strap 30 to the second strap 40. The total stretch of the strap system 100 may be set such that in combination with the inherent stretch properties of the rest of the support garment 600, the total stretch may provide a comfortable fit of the support garment 600 around the torso of the wearer. In other aspects, the strap system 100 may be set such that the support garment 600 may be donned or doffed without decoupling the first strap 30 and the second strap 40 from one another.

Figure 7B:
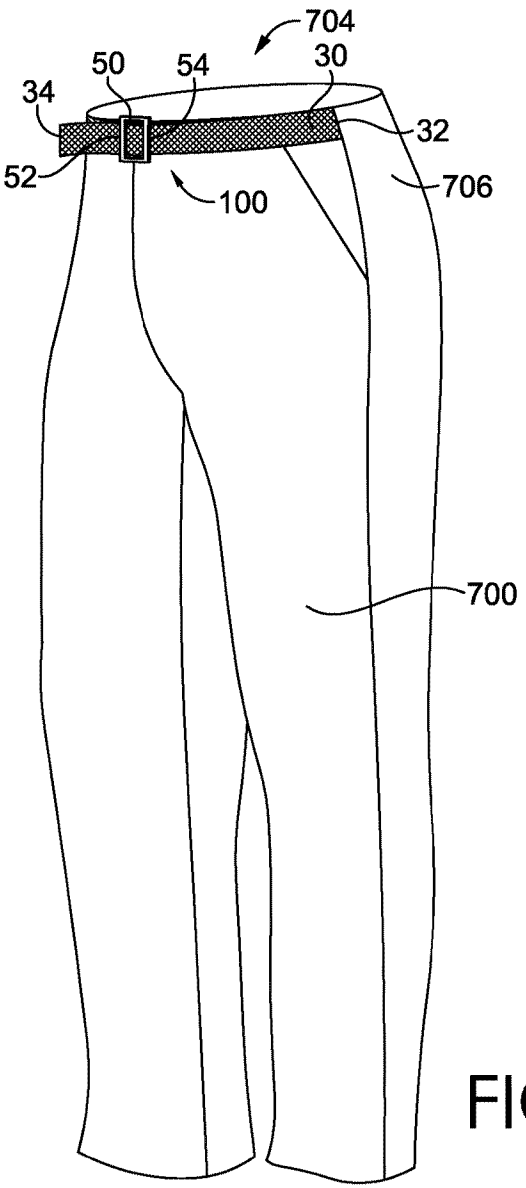
FIG. 7B illustrates the perspective view of the lower body garment shown in FIG. 7A with the strap system in a coupled state, in accordance with aspects herein.
Figure 7A:
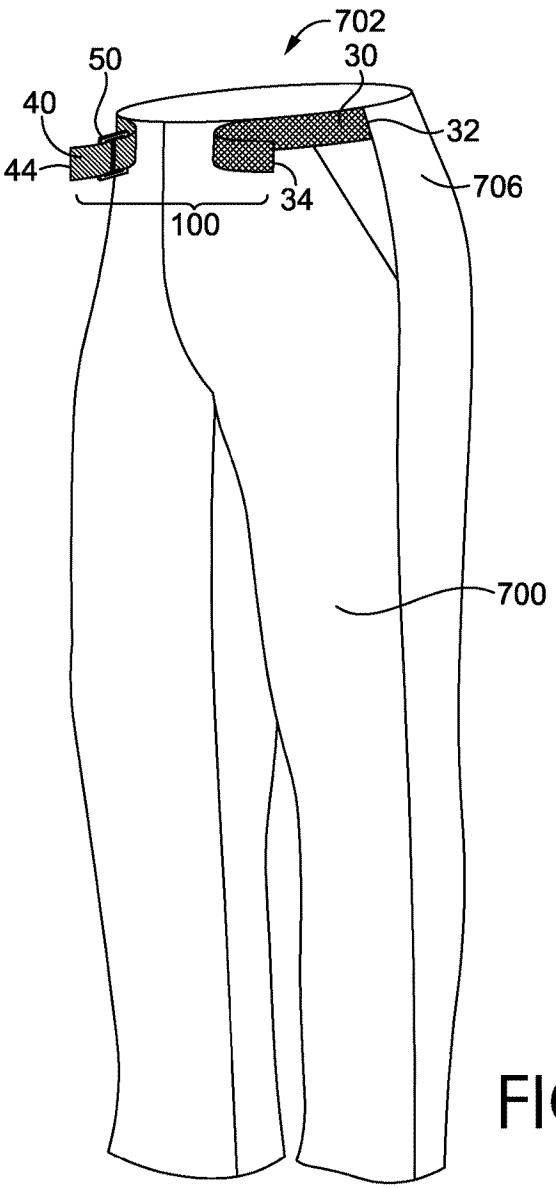
FIG. 7A illustrates a front perspective view of a lower body garment with a strap system as described herein where the strap system is in an uncoupled state, in accordance with aspects herein.

FIGS. 7A and 7B depict perspective views of a lower body garment 700 where the strap system 100 is used as a waistband support system. FIG. 7A depicts a front perspective view 702 of the lower body garment 700 in an open configuration ready to be worn by a wearer. As shown, the first strap 30 of the strap system 100 is fixed to a first side 706 of the lower body garment 700 and the second strap 40 of the strap system 100 is fixed to a second side (not shown) of the lower body garment 700. The coupling mechanism 50 can be initially coupled to the second strap 40, as shown, or alternatively, may be initially coupled to the first strap 30 (not shown). FIG. 7B depicts a perspective view 704 of the lower body garment 700 in a closed configuration where the coupling mechanism 50 is configured to couple the first strap 30 to the second strap 40. The total stretch of the strap system 100 may be set such that in combination with the inherent stretch properties of the textile material forming the lower body garment 700, the total stretch may provide a comfortable fit of the lower body garment 700. In other aspects, the strap system 100 may be set such that the lower body garment 700 may be donned or doffed without decoupling the first strap 30 and the second strap 40 from one another.

Figure 8B:
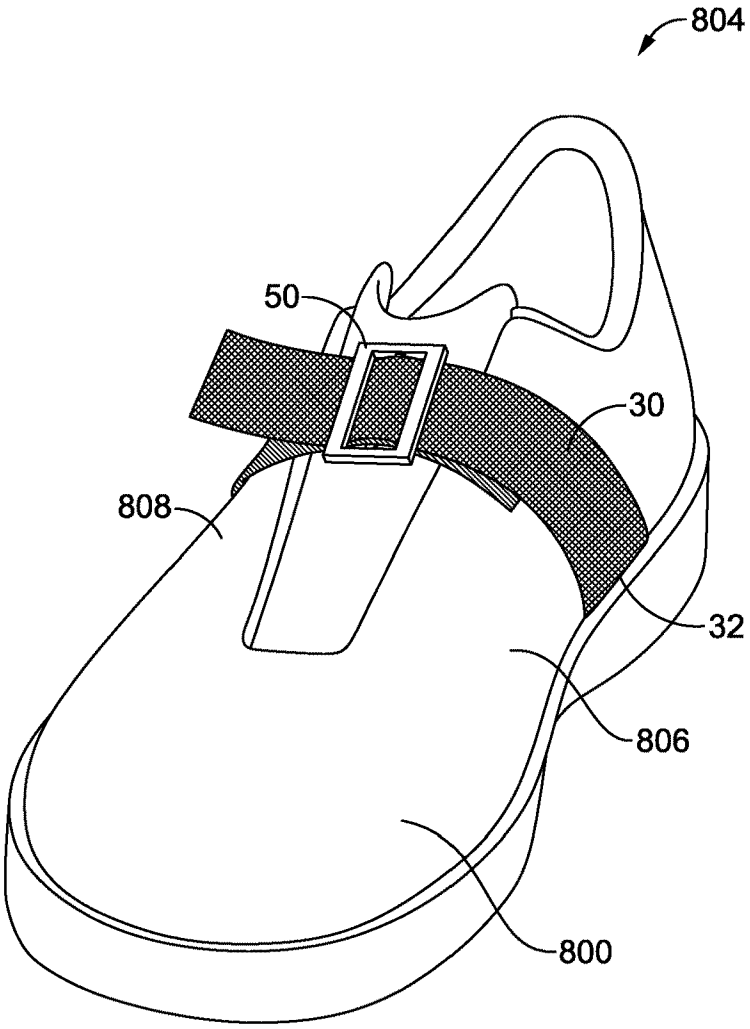
FIG. 8B illustrates the perspective view of the article of footwear shown in FIG. 8A with the strap system in a coupled state, in accordance with aspects herein.
Figure 8A:
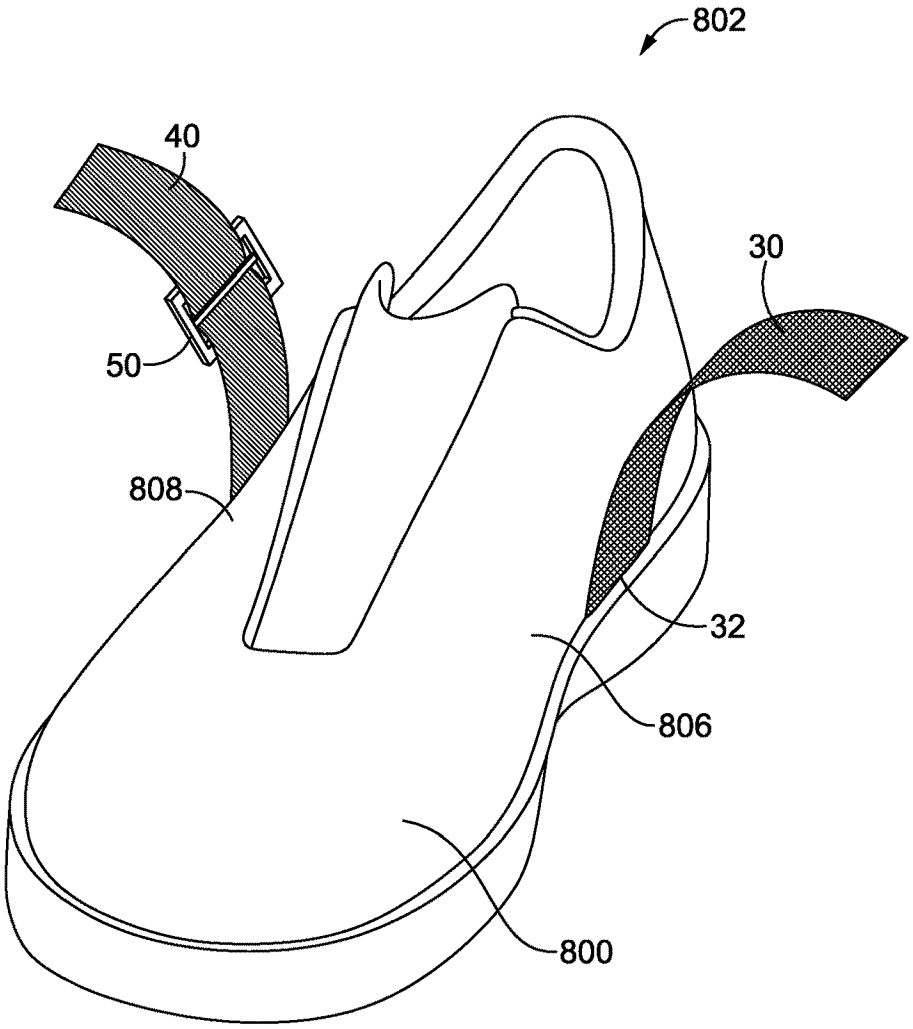
FIG. 8A illustrates a perspective view of an article of footwear with a strap system as described herein where the strap system is in an uncoupled state, in accordance with aspects herein.

FIGS. 8A and 8B depict perspective views of an article of footwear 800. As shown, the strap system 100 is used as a securing system configured to extend across the instep portion of the article of footwear 800. FIG. 8A depicts a perspective view 802 of the article of footwear 800 in an open configuration ready to be worn by a wearer. The first strap 30 of the strap system 100 is fixed to a first (medial) side 806 of the article of footwear 800 and the second strap 40 of the strap system 100 is fixed to a second (lateral) side 808 of the article of footwear 800. The coupling mechanism 50 can be initially coupled to the second strap 40, as shown, or alternatively, may be initially coupled to the first strap 30 (not shown). FIG. 8B depicts a perspective view 804 of the article of footwear 800 in a closed configuration where the coupling mechanism 50 is configured to couple the first strap 30 to the second strap 40. The total stretch of the strap system 100 may be set such that in combination with the inherent stretch properties of the material forming the article of footwear 800, the total stretch may provide a comfortable fit of the article of footwear 800. In other aspects, the strap system 100 may be set such that the article of footwear 800 may be donned or doffed without decoupling the first strap 30 and the second strap 40 from one another.

Figure 9:
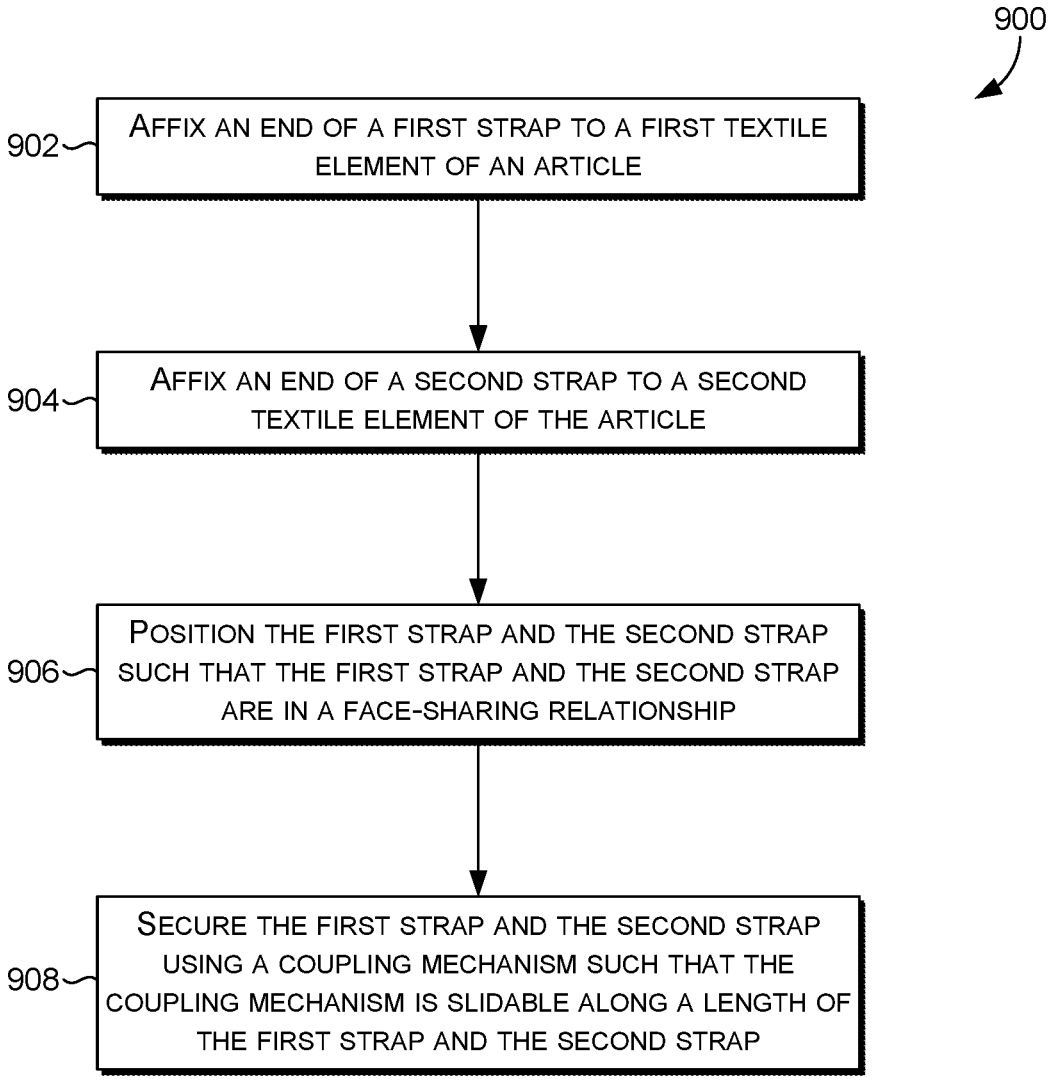
FIG. 9 illustrates a flow diagram of a method for assembling the strap system shown in FIG. 1, in accordance with aspects herein.

FIG. 9 illustrates a flow diagram 900 of a method for assembling the strap system 100 described herein. Initially, in step 902, a first end of a first strap, such as, for example, the first end 32 of the first strap 30 (as shown in FIG. 1), may be fixed to a textile element, such as, for example, the first textile element 10. Similarly, in step 904, a fourth end of a second strap, such as, for example, the fourth end 42 of the second strap 40, may be fixed to a textile element, such as, for example, the second textile element 20 (as shown in FIG. 1). In step 906, the first strap and the second strap are positioned in a face sharing relationship. This may be done by, for example, threading a third end, such as the third end 44, of the second strap through a coupling mechanism, such as, for example, the coupling mechanism 50 (as shown in FIG. 1), in a first direction starting from a second side toward a first side of the coupling mechanism. The second end, such as, for example, the second end 34 (as shown in FIG. 1), of the first strap may then be threaded through the coupling mechanism, such as, for example, the coupling mechanism 50 (as shown in the figures) in a second direction starting from the first side toward the second side of the coupling mechanism over the second strap. This results in the first strap and the second strap being coupled to one another by the coupling mechanism, as shown at step 908, where the coupling mechanism is slidable along a length of the strap system that includes the length of first strap and/or the length of the second strap. As described above, the total stretchability of the strap system is determined based on the location of the coupling mechanism. For example, when the coupling mechanism is closer to the first end of the first strap, the strap system has a total stretchability that is less than the total stretchability provided when the coupling mechanism is closer to the fourth end of the second strap.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An upper body garment comprising:

a first textile element forming a first portion of the upper body garment;

a second textile element forming a second portion of the upper body garment; and a strap system comprising:

a first strap having a first end and a second end, the first end of the first strap fixed to the first textile element of the upper body garment, wherein the first strap has a first amount of stretch;

a second strap having a third end and a fourth end, the fourth end of the second strap fixed to the second textile element of the upper body garment, wherein the first strap is in a face sharing relationship with the second strap, wherein the second strap has a second amount of stretch, wherein the first amount of stretch of the first strap is greater than the second amount of stretch of the second strap; and a coupling mechanism securing the first strap to the second strap, wherein the coupling mechanism is slidable along a length of the first strap and the second strap;

wherein an amount of stretch of the strap system is dependent on a location of the coupling mechanism along the length of the first strap and the second strap.

2. The upper body garment of claim 1, wherein the first strap and the second strap remain in the face sharing relationship when the coupling mechanism is positioned at different locations along the length of the first strap and the second strap.

3. The upper body garment of claim 1, wherein the first end of the first strap and the third end of the second strap are positioned at a first side of the coupling mechanism, and wherein the second end of the first strap and the fourth end of the second strap are positioned at an opposite second side of the coupling mechanism.

4. The upper body garment of claim 1, wherein the second end of the first strap is unfixed to the second textile element of the upper body garment, and wherein the third end of the second strap is unfixed to the first textile element of the upper body garment.

5. The upper body garment of claim 1, wherein the upper body garment is a bra, and wherein the strap system forms at least a portion of a shoulder strap of the bra.

6. The upper body garment of claim 1, wherein the upper body garment is a bra, and wherein the first textile element forms an apex portion of a breast-covering surface of the bra, and wherein the second textile element forms a shoulder strap of the bra.

7. The upper body garment of claim 1, wherein when the coupling mechanism is located closer to the first end of the first strap and the third end of the second strap, the strap system has a first amount of strap system stretch, and wherein when the coupling mechanism is located closer to the second end of the first strap and the fourth end of the second strap, the strap system has a second amount of strap system stretch that is greater than the first amount of strap system stretch.

* * * * *